United States Patent [19]

Kamikawa

[11] 4,215,618

[45] Aug. 5, 1980

[54] APPARATUS FOR PRESETTING MUSICAL TONE EFFECTS IN ELECTRONIC MUSICAL INSTRUMENT

[75] Inventor: Nobuo Kamikawa, Ageo, Japan

[73] Assignee: Kabushiki Kaisha Kawai Gakki Seisakusho, Hamamatsu, Japan

[21] Appl. No.: 868,716

[22] Filed: Jan. 11, 1978

[30] Foreign Application Priority Data

Jan. 17, 1977 [JP] Japan ..... 52/2984
Jan. 17, 1977 [JP] Japan ..... 52/2985

[51] Int. Cl.[2] ..... G10H 1/00
[52] U.S. Cl. ..... 84/1.24
[58] Field of Search ..... 84/1.01, 1.03, 1.24, 84/DIG. 23, 115

[56] References Cited

U.S. PATENT DOCUMENTS

| | | | |
|---|---|---|---|
| 3,939,750 | 2/1976 | Inove et al. | 84/1.01 |
| 3,981,218 | 9/1976 | Luce | 84/1.26 |
| 3,992,969 | 11/1976 | Robinson et al. | 84/1.01 |
| 3,999,458 | 12/1976 | Suzuki | 84/1.01 |

*Primary Examiner*—J. V. Truhe
*Assistant Examiner*—Forester W. Isen
*Attorney, Agent, or Firm*—Haseltine, Lake & Waters

[57] ABSTRACT

An arrangement for presetting musical tone effects in an electronic musical instrument in which a first system is provided with a plurality of tablet-shaped switches which are connected through respective memory elements in a memory circuit to respective control electrodes of a plurality of gates for selection of musical tone effects. A second system is also provided with tablet-shaped switches which are connected to control electrodes of gates for selection of musical tone effects. Either one of the first or second system is selected, and the memory circuit has a write switch arranged so that after completion of the writing of output signals of respective tablet switches by operation of the write switch, the memories remain unchanged by the writing, even by operation of respective tablet-shaped switches. The memory elements in the memory circuit of the first system are in a plurality of lines in conjunction with a plurality of line selection switches for selecting the respective lines of the memory elements. To select between the two systems, a plurality of gates open the first system while closing the second system when the line selection switches are selective operated.

1 Claim, 4 Drawing Figures

APPARATUS FOR PRESETTING MUSICAL TONE EFFECTS IN ELECTRONIC MUSICAL INSTRUMENT

BACKGROUND OF THE INVENTION

This invention relates to apparatus for presetting musical tone effects in an electronic musical instrument in which musical tone effects are produced by selection of tone colors such as of the flute kind, the string kind and others. Musical tone effects produced by selection of feet ratios of 16′, 8′, 4′, 2⅔′, 2′ and others, and musical tone effects produced by selection of vibrato, tremolo, mandoline, chorous and others are set previously to a musical performance. Any of the various effects previously set are added to a musical tone by a single touch operation during the musical performance.

One object of the present invention is to provide an arrangement wherein plural tablet switches are used also for memory, and thereby the number of the constructional parts are decreased remarkably.

An additional object of the present invention is to provide an arrangement wherein the preset operation for memory and manual set for usual operation can be simply and easily changed over by a selection means.

A further object of the present invention is to provide an arrangement wherein presetting of plural groups are carried out and these are changed over by a single touch operation in course of a musical performance, and thereby adding a large number of various musical tone effects so that the musical performance can be enriched.

SUMMARY OF THE INVENTION

The objects of the present invention are achieved by providing an arrangement for presetting musical tone effects in an electronic musical instrument by providing a first system which is so constructed that plural tablet switches are connected through respective memory elements in a memory circuit to respective control electrodes of plural gates for selection of musical tone effects. A second system which is so constructed that the foregoing tablet switches are connected to the control electrodes of plural gates for selection of musical tone effects. A selection means for selecting either one of the first system and the second system, and the memory circuit is provided with a write switch, and is so arranged that after completion of writing of output signals of the respective tablet switches by operation of the write switch, there is not caused any change in the memory made by the writing even by operation of the respective tablet switches. According to another feature of this invention, in the above arrangement, the memory elements in the memory circuit of the firsts system are arranged in plural lines, and plural line selection switches for selecting the respective lines of the memory elements are provided. The foregoing selection means is composed of plural gates that open the first system while closing the second series when the foregoing line selection switches are selectively operated.

The novel features which are considered as characteristic for the invention of set falls in particular in the appended claims. The invention itself, however, both as to its construction and its method of evaporation, together with additional objects and advantages thereof, will be best understood from the following description of specific embodiments when read in connection with the accompanying drawings.

DESCRIPTION OF THE PREFERRED EMBODIMENTS

Figure 1:
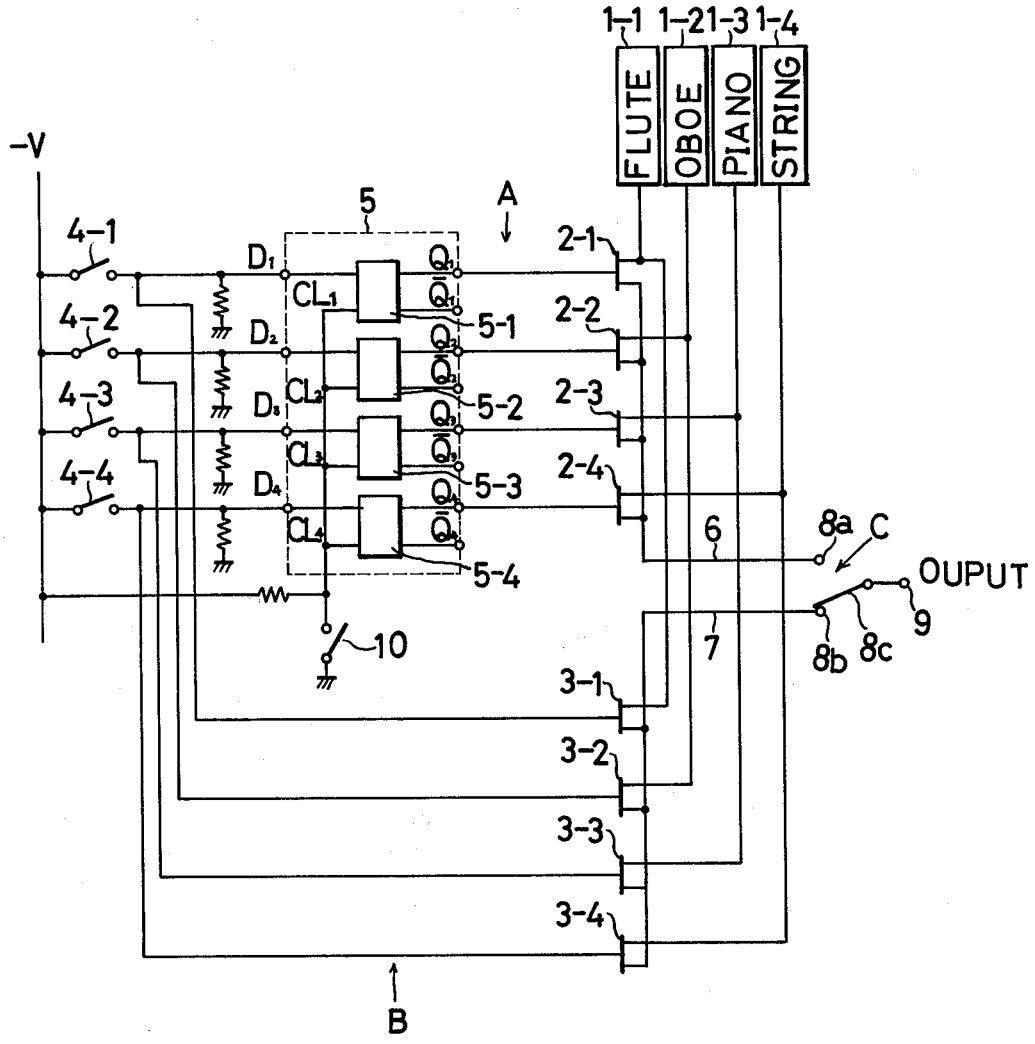
FIG. 1 is a schematic circuit diagram and shows one embodiment of the present invention.

Referring to FIG. 1, numerals 1-1 . . . 1-4 denote signal sources for musical tone effects and, more particularly, tone color filters of a flute kind, an oboe kind, a piano kind and a string kind. Output terminals of these signal sources 1-1 . . . 1-4 are connected to respective input terminals of a first groups of gates 2-1 . . . 2-4 and a second group of gates 3-1 . . . 3-4 for selection of musical tone effects, respectively.

Numerals 4-1 . . . 4-4 denote tablet or button switches which are in common to a first system A and a second system B as mentioned in detail hereinafter. The first system A is so constructed that the tablet switches 4-1 . . . 4-4 are connected to control electrodes of a first group of gates 2-1 . . . 2-4 through respective memory elements 5-1 . . . 5-4 of a memory circuit 5. The second system B is so constructed that the tablet switches 4-1 . . . 4-4 are connected directly to control electrodes of a second group of gates 3-1 . . . 3-4. Output terminals of the first group of gates 2-1 . . . 2-4 and output terminals of the second group of gates 3-1 . . . 3-4 are connected respectively through their common lines to respective terminals 6,7. These terminals 6,7 are connected to a selection means C.

The selection means C comprises a changeover switch 8, and stationary contacts **8*a*,8*b* thereof are connected to the terminals 6,7. A movable contact 8*c* thereof is connected to an output terminal 9. The terminal 9** is connected to a speaker through an amplifier and others, though not illustrated.

Each of the memory elements 5-1 . . . 5-4 in the memory circuit 5 is composed of a "D" latch, and respective terminals $D_1$ . . . $D_4$ of those elements are connected to the tablet switches 4-1 . . . 4-4. Respective output terminals $Q_1$ . . . $Q_4$ thereof are connected to the control electrodes of the first group of gates 2-1 . . . 2-4, and clock terminals $CL_1$ . . . $CL_4$ thereof are connected in common to ground through a write switch 10. Input sides of the tablet switches 4-1 . . . 4-4 are connected to common to an electric source −V. The gates 2-1 . . . 2-4 and 3-1 . . . 3-4 of the first and the second groups are composed of respective, FETs.

If, now, the write switch 10 is in its open position as illustrated, the memory elements 5-1 . . . 5-4 are applied at their clock terminals $CL_1$ . . . $CL_4$ with −V (called "L" hereinafter), so that they are brought into such a state that the memories thereof are eliminated. If the movable contact **8*c* of the selection means C is connected to the stationary contact 8*b* so as to select the second system B and any desired one of the tablet switches 4-1 . . . 4-4 is closed, the corresponding one of the second group of gates 3-1 . . . 3-4** is opened and thus a musical tone with a desired tone color can be obtained.

For instance, if the tablet switches 4-1, 4-3 are closed, the gates 3-1, 3-3 of the second group are opened and thereby musical tones of the flute kind and the piano kind are simultaneously obtained. Thus, a musical tone of any desired tone color can be obtained by properly closing the tablet switches 4-1 . . . 4-4.

If, next, preset is intended, under the condition that the second system B is selected, any desired tablet switches, for instance, switches 4-2, 4-4 are closed, and the gates 3-2, 3-4 of the second system B are opened, so that musical tones with the oboe kind and the string kind are obtained. After recognizing this, the write switch 10 is closed. Thereby, the memory elements 5-1 . . . 5-4 are applied at their clock terminals $CL_1 \ldots CL_4$ with O V (called "H" hereinafter), and the data L is memorized in each of the second and fourth memory elements 5-2,5-4. The L is obtained from each of the output terminals $Q_2$, $Q_4$ and the gates 2-2, 2-4 of the first group are opened.

There is not caused any change in the memories of the memory elements 5-2, 5-4 regardless of the way the tablet switches 4-1 . . . 4-4 may be operated after the writing is once carried out.

Thus, under such a memory condition and in such a selection condition of the second system B as above, a musical tone signal with any desired tone color can be obtained by such a manual operation that the tablet switches 4-1 . . . 4-4 are properly operated.

If, next, the first system A is selected by changeover of the selection means C, musical tones of the oboe kind and the string kind are obtained due to the foregoing opening condition of the gates 2-2,2-4 of the first group. Additionally, by selecting the second system B, a musical tone with any desired tone color can be obtained. If, next, the write switch 10 is opened, the clock terminals $CL_1 \ldots CL_4$ become L and the memories are eliminated.

The embodying example shown in FIG. 1 is more or less troublesome because it is so designed that the write switch 10 and the changeover switch 8 constituting the selection means C may be separately operated.

Figure 2:
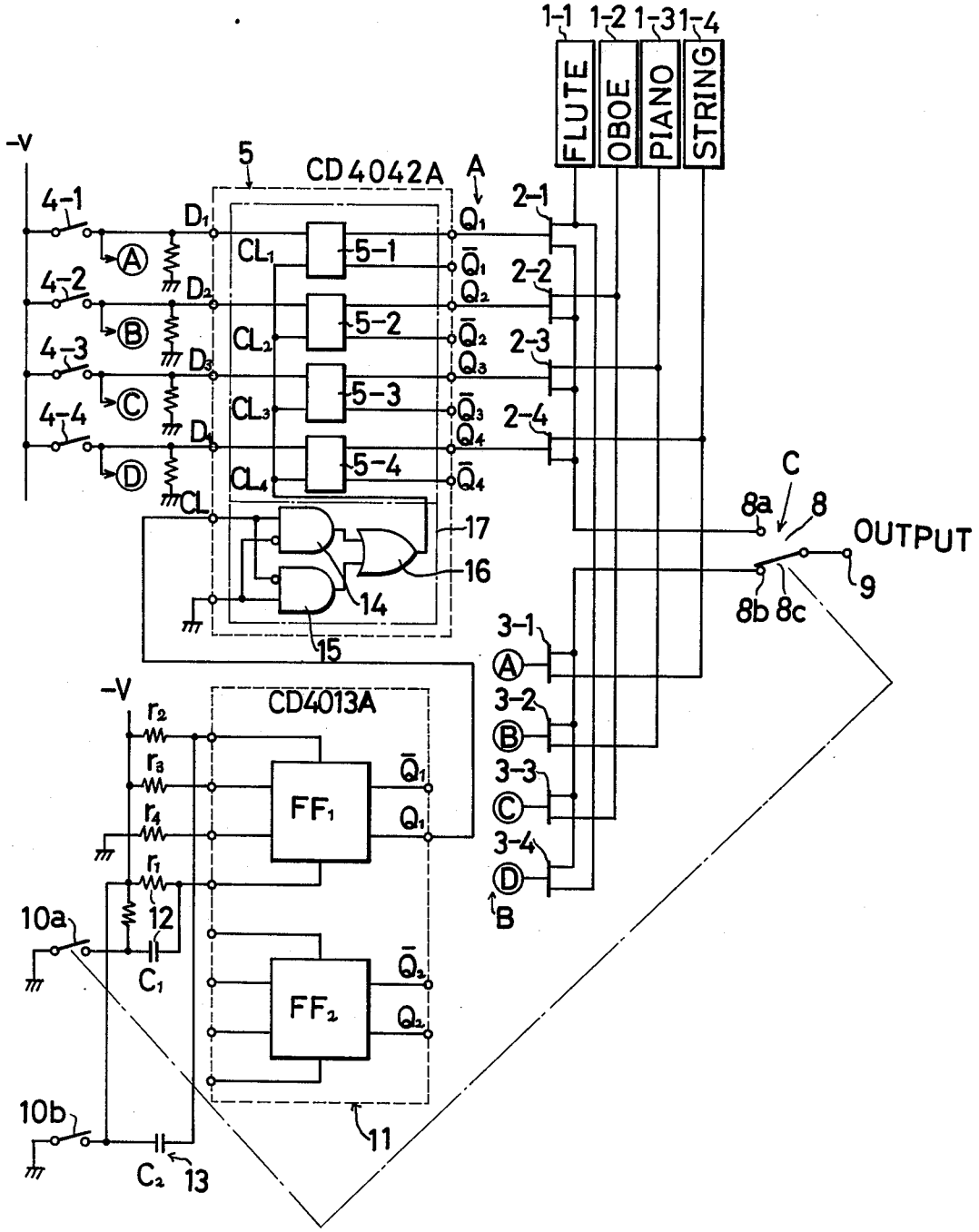
FIGS. 2 to 4 are schematic circuit diagrams of additional embodiments of the present invention.

FIG. 2 shows such a modification that the write switch 10 is divided into a pure write switch 10*a* and an elimination switch 10*b*, and it is arranged so that the write switch 10*a* may be moved in conjunction with the changeover switch 8. As a result, the writing can be carried out simultaneously with selection of the first system A and after completion of the writing, the first system A and the second system B can be selected at will.

Namely, a dual "D" type flip-flop 11 (CD4013A) is provided, and a cos/mos quad clocked "D" latch (CD4042A) is used as the memory circuit 5, and a reset terminal R on one side of a $FF_1$ of the flip-flop 11 is connected to ground through a differential circuit 12' which comprises a resistance $r_1$ and a condenser $c_1$. The foregoing write switch 10*a*, and a set terminal S on the other side thereof is connected to ground through a differential circuit 13' which comprises a resistance $r_2$ and a condenser $C_2$. The elimination switch 10*b*, and a data terminal D thereof is connected through a resistance $r_3$ to an electric source $-V$, and a clock terminal CL thereof is connected to ground through a resistance $r_4$. An output terminal $Q_1$ thereof is connected to a clock terminal CL of the memory circuit 5. The terminal CL is connected to respective $CL_1 \ldots CL_4$ of "D" latches, constituting the memory elements 5-1 . . . 5-4, through a logic circuit 17 comprising two AND circuits 14,15 and a single OR circuit 16.

Thus, in the condition shown in FIG. 2, the output terminal $Q_1$ of the $FF_1$ is H and the output of the logic circuit 17 is L, and the "D" latches each is in such a condition that the writing operation is not carried out.

If, next, the tablet switches 4-1 . . . 4-4 are set, and the changeover switch 8 is operated to select the first system A and simultaneously the write switch 10*a* is closed, a pulse is applied to the reset terminal R through the differential circuit 12. As a result, the $FF_1$ is reset and the terminal $Q_1$ becomes L and the output of the logic circuit 17 becomes H and thereby the outputs of the respective tablet switches 4-1 . . . 4-4 are memorized in the respective elements 5-1 . . . 5-4.

Even if the changeover switch 8 is, next, operated to select the second system B, the memories thereof are continued to be held because the $FF_1$ is kept in its reset condition. Thus, respective gates corresponding to operations of the tablet switches 4-1 . . . 4-4 are opened and thereby tone color effects can be obtained.

If, next, the elimination or erasure switch 10*b* is closed, a pulse is applied to the set terminal S through the differential circuit 13. As a result the output of the terminal $Q_1$ becomes H and the output of the logic circuit 17 becomes L, so that the memories are eliminated. An $FF_2$ on the other side is used, for instance, for another set apparatus for other musical tone effects, though not illustrated.

This embodying example is more or less complicated in construction because the dual "D" type flip-flop and the cos/mos quad "D" latch are used. However, this is not substantially different from an arrangement in which a flip-flop having a set terminal and a reset terminal is provided, and the write switch 10*a* and the elimination switch 10*b* are connected to the set terminal and the reset terminal, and an output terminal Q or $\overline{Q}$ thereof is connected to clock terminals $CL_L \sim CL_4$ so that writing may be effected by operating the write switch 10*a* and elimination or erasure may be effected by operating the elimination switch 10*b*.

The above examples are such cases that any desired tone color is obtained by selecting any tone color filter. However, a musical tone effect produced by any combination of various feet ratios can be obtained if the signal sources 1-1 . . . 1-4 are composed of tone sources of 16', 8', 4', 2' in feet ratio.

Figure 3:
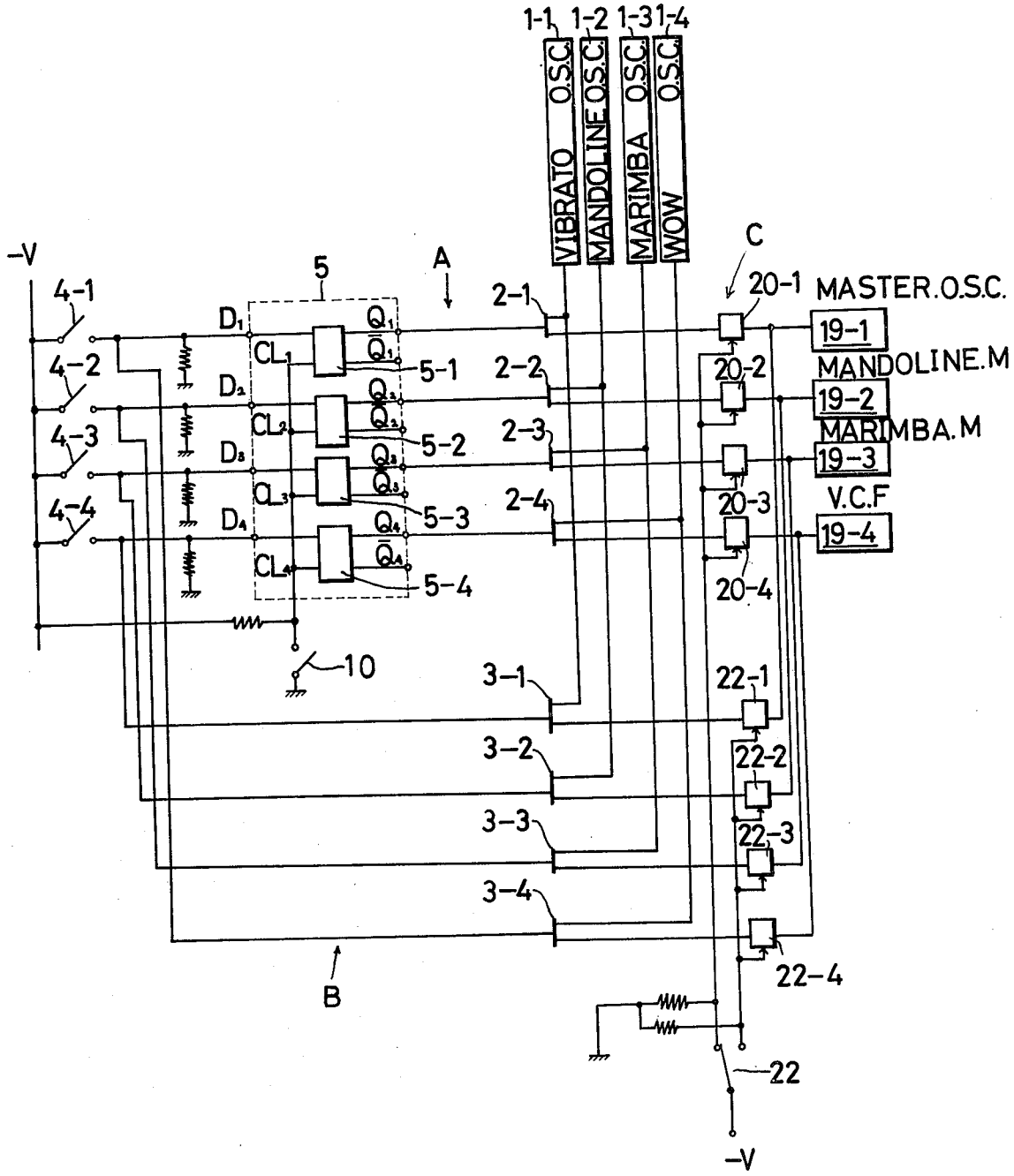

In the case where it is intended to obtain various musical tone effects of vibrato, mandoline marimba, wow and others, it is constructed that, for instance, as shown in FIG. 3, the signal sources 1-1 . . . 1-4 are composed of a vibrato oscillator, a mandoline oscillator, a marimba oscillator and a wow oscillator. Furthermore, it is so arranged that output signals thereof are applied to a master oscillator 19-1, a mandoline modulator 19-2, a marimba modulator 19-3, a voltage controlled type filter 19-4 (VOF) respectively, so as to be modulated. In this case, the selection means C is composed of, for instance, gates 20-1 . . . 20-4 and 21-1 . . . 21-4 interposed in output circuits of the gates 2-1 . . . 2-4, and 3-1 . . . 3-4, and a changeover switch 22 for controlling them.

Figure 4:
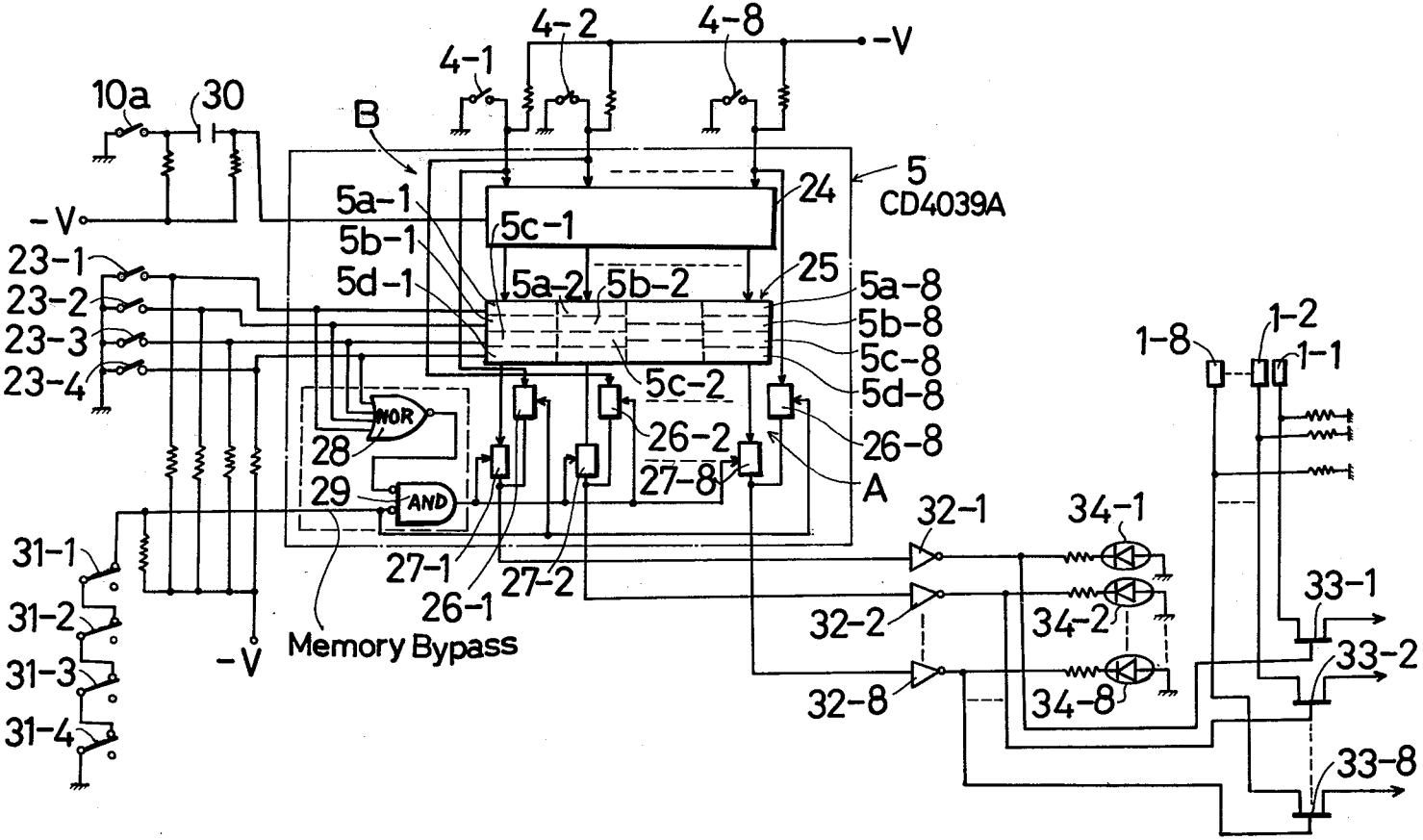

FIG. 4 shows another embodying example of this invention. In this example, memory elements in a memory circuit 5' are arranged to form plural lines 5*a*-1 . . . 5*a*-8, 5*b*-1 . . . 5*b*-8, 5*c*-1 . . . 5*c*-8 and 5*d*-1 . . . 5*d*-8, and corresponding line selection switches 23-1 . . . 23-4 are provided, so that by operation of each of these switches the memory elements in each corresponding line can be simultaneously taken out and thus an increased variety of different musical tone effects can be added in the course of a musical performance.

More in detail, a cos/mos 4 word by 8 bit random-access NDRO memory (CD 4039A) is used as the memory circuit 5'. The memory circuit 5' comprises an input gate 24, a 4 word×8 bit memory 25 corresponding to the foregoing plural lines of memory elements, transmission gates 26-1 . . . 26-8, and 27-1 . . . 27-8, a NOR circuit 28 and an AND circuit 29. A write switch 10a is connected to a control electrode of the input gate 24 through a differential circuit 30, and the line selection switches 23-1 . . . 23-4 are connected to terminals of respective words of the memory 25, as well as being connected to the NOR circuit 28. Additionally, an input terminal on one side of the AND circuit 29, that is, a memory bypass terminal is connected to ground through switches 31-1 . . . 31-4 which are connected in series and are arranged to be opened by closing of the line selection switches 23-1 . . . 23-4.

Bit inputs of the line selection switches 4-1 . . . 4-8, and bit outputs thereof are connected through respective inverters 32-1 . . . 32-8 to gates 33-1 . . . 33-8 for selection of musical tone effects and illumination diodes 34-1 . . . 34-8.

Thus, the first system A is arranged by such a system that the tablet switches 4-1 . . . 4-8 are connected to the gates 33-1 . . . 33-8 through the input gate 24, the 4 word×8 bit memory 25, the transmission gates 27-1 . . . 27-8 and the inverters 32-1 . . . 32-8.

The second system B is arranged from such a system that the tablet switches 4-1 . . . 4-8 are connected to the gates 33-1 . . . 33-8 through the transmission gates 26-1 . . . 26-8 and the inverters 32-1 . . . 32-8.

The selection means C is composed of the line selection switches 23-1 . . . 23-8, the transmission gates 26-1 . . . 26-8, 27-1 . . . 27-8, the NOR circuit 28, the AND circuit 29 and the switches 31-1 . . . 31-4.

The signal sources 1-1 . . . 1-8 may all be in the form of tone color filters, or they may be divided into plural groups, as for instance, into two groups. One group of these 1-1 . . . 1-4 may be composed of tone color filters and the other group 1-5 . . . 1-8 may be composed of tone source of 16', 8', 4', 2', in feet ratio.

Thus, in the illustrated condition, the memory bypass terminal is H and the transmission gates 26-1 . . . 26-8 are in closed condition, and thereby the second system B is selected. By operation of any of the tablet switches 4-1 . . . 4-8, corresponding one(s) of the gates 33-1 . . . 33-8 are opened to add any desired musical tone effects. If memorization in the memory elements 5a-1 . . . 5a-8, 5b-1 . . . 5b-8, 5c-1 . . . 5c-8, 5d-1 . . . 5d-8 in the respective lines is intended, in the first place, the tablet switches 4-1 . . . 4-8 are set into a condition to be memorized. If, now, it is intended to cause the first line 5a-1 . . . 5a-8 to memorize, for instance, then the line selection switch 23-1 is closed. Thereby, the memory bypass terminal becomes L and the transmission gates 26-1 . . . 26-8 are closed. As a result, the output of the AND gate 29 becomes H and the transmission gates 27-1 . . . 27-8 are opened, and thus the first system A is selected. If, now, the write switch 10a is closed, a pulse is applied to the input gate 24 through the differential circuit 30 to open the same, and thereby the information given from the tablet switches 4-1 . . . 4-8 is memorized in the memory elements 5a-1 . . . 5a-8. Thus, at each time when any of the line selection switches 23-1 . . . 23-4 is closed, information are memorized in the memory elements in each line 52-1 . . . 52-8, 5b-1 . . . 5b-8, 5c-1 . . . 5c-8, 5d-1 . . . 5d-8.

If in the line selection switches 23-1 . . . 23-4 are properly closed in a musical performance, then in almost the same manner as in the case of memorization, the transmission gates 26-1 . . . 26-8 are closed and the transmission gates 27-1 . . . 27-8 are opened. Any corresponding ones of the memory element 5a-1 . . . 5a-8, 5b-1 . . . 5b-8, 5c-1 . . . 5c-8, 5d-1 . . . 5d-8 in the lines corresponding to the closed one(s) of the line section switches 23-1 . . . 24-4 are selected, and the information previously memorized are provided to open respective gates for musical tone effects. As a result, predetermined musical tone effects can be obtained.

Without further analysis, the foregoing will so fully reveal the gist of the present invention that others can, by applying current knowledge, readily adapted it for various applications without omitting features that, from the standpoint of prior art, fairly constitute esential characteristics of the generic or specific aspects of this invention, and therefore, such adaptations should and are intended to be comprehended within the meaning and range of equivalence of the following claims.

I claim:

1. An arrangement for presetting musical tone effects in an electronic musical instrument, comprising: a first system having plural tablet switches, respective memory elements in a memory circuit, plural gates with respective control electrodes, said plural tablet switches being connected to respective memory elements in said memory circuit to control respective electrodes of said plural gates for selection of musical tone effects; a second system having said tablet switches connected to control electrodes of plural gates for selection of musical tone effects; selection means for selecting either one of the first system and the second system; said memory circuit having a write switch and being so arranged that after completion of writing output signals of respective tablet switches by operation of said write switch the memory contents remain unchanged until said write switch is operated again; plural line selection switches; said memory elements in said said memory circuit of said first system being arranged in plural lines; said plural line selection switches selecting the respective lines of said memory elements; said selection means having plural gates for opening said first system and closing said second system when said line selection switches are selectively operated, said memory circuit comprising further a random-access memory having input gate means, memory means connected to output means of said input gate means, transmission gate means connected to output means of said memory means; and indicating means arranged to be operated when said gates for selection of musical tone effects are opened; said memory means having memory elements arranged to form plural lines, each of which corresponds to one of said line selection switches, so that by operation of each of said switches the memory elements in each corresponding line can be simultaneously taken out for providing an increased variety of different musical tone effects to be added in the course of a musical performance, said write switch being connected to a control electrode of said input gate means through a differential circuit, said line selection switches being connected to terminals of respective words of said memory means, said line selection switches being also connected to a NOR circuit, and to an AND gate having an input terminal connected to ground through auxiliary switches connected in series, said auxiliary switches being arranged to be opened by closing the line selection switches.

* * * * *